United States Patent [19]

Taylor et al.

[11] 4,121,076

[45] Oct. 17, 1978

[54] CONVERTIBLE SWITCH

[75] Inventors: Glenn R. Taylor; John H. Mullen, both of Brighton Township, Beaver County; Stephen S. Dobrosielski, Beaver, all of Pa.

[73] Assignee: Westinghouse Electric Corp., Pittsburgh, Pa.

[21] Appl. No.: 793,996

[22] Filed: May 5, 1977

Related U.S. Application Data

[63] Continuation of Ser. No. 653,043, Jan. 28, 1976, abandoned.

[51] Int. Cl.[2] ..... H01H 13/04

[52] U.S. Cl. ..... 200/280; 200/307

[58] Field of Search ..... 200/16 A, 280, 281, 200/295, 303, 307, 5 R, 5 B; 335/132, 197, 202

[56] References Cited

U.S. PATENT DOCUMENTS

| | | | |
|---|---|---|---|
| 2,419,072 | 4/1947 | Hall | 200/280 X |
| 2,811,617 | 10/1957 | Townsend | 200/280 X |
| 2,822,450 | 2/1958 | Groudy et al. | 200/280 X |
| 3,290,456 | 12/1966 | Meyer | 200/307 X |
| 3,451,018 | 6/1969 | DiMarco | 335/197 |
| 3,555,215 | 1/1971 | Dehn | 200/280 X |
| 3,586,795 | 6/1971 | Mentel et al. | 200/307 |
| 3,614,363 | 10/1971 | Fujita | 200/280 X |
| 3,676,628 | 7/1972 | Kane | 200/280 |
| 3,676,630 | 7/1972 | Dennison | 200/307 X |
| 3,735,058 | 5/1973 | Berry | 200/276 X |
| 3,855,558 | 12/1974 | Hayward | 200/280 X |

FOREIGN PATENT DOCUMENTS

| | | | |
|---|---|---|---|
| 661,063 | 4/1963 | Canada | 200/307 |

*Primary Examiner*—James J. Gill
*Attorney, Agent, or Firm*—L. P. Johns

[57] ABSTRACT

A convertible switch characterized by a dielectric housing comprising a contact compartment, a pair of stationary contacts at one end of the compartment, movable contacts movable between open and closed positions, a contact carrier slidably mounted in the housing and comprising a bridging contact member upon which the movable contacts are mounted, a coil spring at one end of the contact carrier for biasing the movable contacts in one of the open and closed position, and the assembly of the contact carrier and spring being reversible within the housing compartment for holding the movable contacts in the other of the open and closed positions.

1 Claim, 8 Drawing Figures

CONVERTIBLE SWITCH

This is a continuation of application Ser. No. 653,043 filed Jan. 28, 1976, now abandoned.

BACKGROUND OF THE INVENTION

1. Field of the Invention

This invention relates to electrical switching devices and, more particularly, to switches which are convertible from normally open to normally closed positions.

2. Description of the Prior Art

In the switch art, selector switches employing a plurality of switches in tandem are used for controlling various electrical equipment such as motor circuits. Most control switches lack the advantage of being designed for normally open or normally closed conditions which are connected to either condition when being installed. When assembling contact blocks, the installer may have to wait for a normally open or normally closed switch if it is not in stock. Associated with the foregoing is the problem of disconnecting a particular switch in tandem with a plurality of contact blocks in order to replace or convert a switch from normally open to normally closed conditions. Moreover, prior convertible switches have involved the disadvantage of employing switch parts which snap out of place when an access cover is removed.

SUMMARY OF THE INVENTION

It has been found in accordance with this invention that the foregoing disadvantages may be overcome by providing a convertible electric switch for use in tandem assembly with a switch actuator, the switch comprising a manual operator, a plurality of switch units disposed in tandem, each switch unit comprising a dielectric housing having integral detachable interlocking means for holding the switch units together, each switch housing having a compartment and a detachable access cover which may be removable without disassembly of adjacent switch units, each switch unit comprising a set of stationary and movable contacts within the housing, movable contact operating means including a guided reciprocal plunger and a bridging contact carrier with each set of stationary contacts, the plunger of each unit being in engagement with the plunger of a next adjacent unit, the movable operating means being reversibly mounted in the housing for holding the movable contacts normally in the open or closed positions of the stationary contacts.

The advantage of the switch device of this invention is that convertible snap-on contact blocks or switch units save money and time for the user by avoiding the necessity of stocking normally open and normally closed switches, and by readily converting the convertible switches to either normally open or normally closed conditions as dictated by requirements at the location of installation.

DESCRIPTION OF THE PREFERRED EMBODIMENTS

Figure 1:
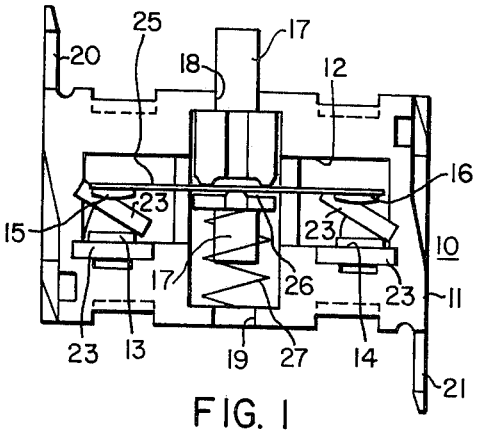
FIG. 1 is an elevational view of a contact block in the normally open position with the cover removed.

In FIG. 1 a contact block or switch is generally shown at 10 and it comprises a housing 11 forming a compartment 12 in which a pair of spaced stationary contacts 13 and 14 are contained, a pair of movable contacts 15 and 16, and a switch operating member or plunger 17. The housing 11 is formed of an electrically insulating material, such as a resin. The compartment 12 contains the movable stationary contacts as well as the switch operating member 17. Aligned apertures 18 and 19 are disposed at opposite upper and lower sides of the housing and communicate with the compartment 12 and serve as guides for the plunger 17. Mounting hooks 20 and 21 are disposed at opposite corners of the housing to enable mounting similar contact blocks 10 together in the manner described below. A detachable cover 22 extends across the compartment 12 to contain the operating parts therein.

Figure 4:
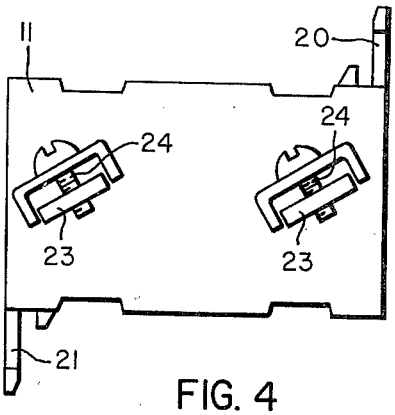
FIG. 4 is an elevational rear view of the contact block.

The stationary contacts 13 and 14 are mounted on the inner ends of similar terminals 23, the outer ends of which (FIG. 4) comprise terminal screw assemblies 24. The movable contacts 15, 16 are disposed at opposite ends of a flexible bridging contact carrier 25, the center portion of which is disposed in a transverse slot 26 in the plunger 17. The plunger 17 having an enlarged central portion with reduced end portions at opposite sides of the center portion is slidable longitudinally within the compartment 12 with the opposite end portion aligned with and extendable through the openings 18, 19. A coil spring 27 is disposed between one side of the housing 11 and the intermediate portion of the plunger 17. The spring 27 has a diameter greater than the apertures 18, 19, as well as the end portions of the plunger 17. In FIG. 1 the coil spring 27 holds the contacts 15 and 16 in the normally open position with respect to stationary contacts 13, 14.

Figure 2:
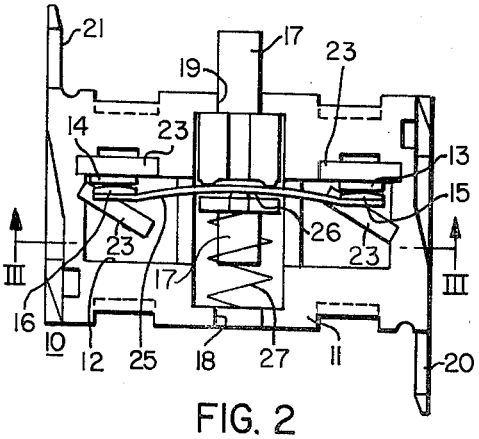
FIG. 2 is an elevational view of the contact block in the normally closed position with the cover removed.
Figure 3:
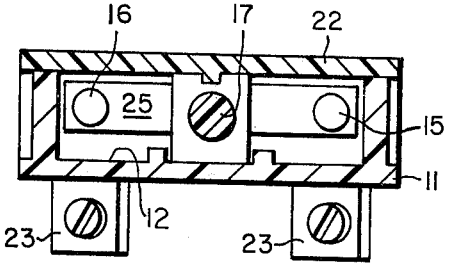
FIG. 3 is a horizontal sectional view taken on the line III—III of FIG. 2, with a cover attached.

In FIG. 2 the contact block 10 is in the normally closed position with the contacts closed. That position is converted from the normally open position of FIG. 1 by removing the plunger 17 and the spring 27, turning the contact blocks 10 through 180° so that the stationary contacts 13, 14 are on the upper side of the compartment 12, and reinserting the plunger 17 and spring with the upper end of the plunger extending through the aperture 19 instead of the aperture 18. In that condition the coil spring 27 retains the plunger in the upper portion of the compartment 12, whereby the contacts are closed.

It is noted that one end of the plunger 17 extends out of the housing in either the normally open or normally closed positions while the other end is recessed within the compartment in both conditions.

Figure 5:
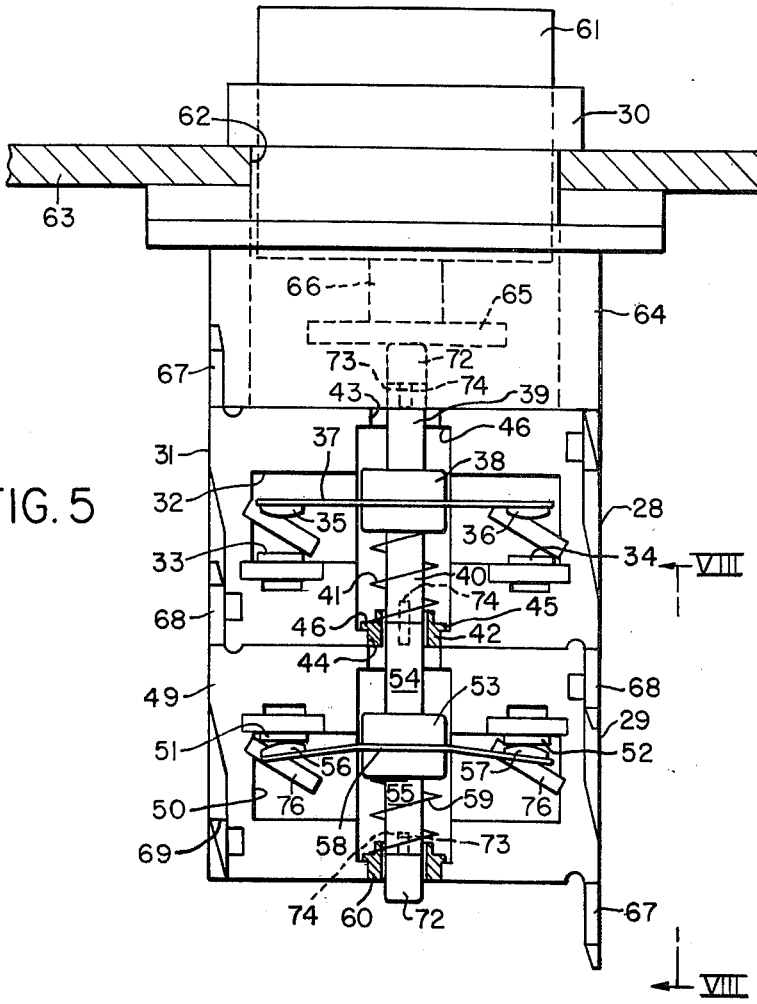
FIG. 5 is an elevational view, partly in section, showing a pair of contact blocks assembled in tandem and attached to a contact block operator.
Figure 8:
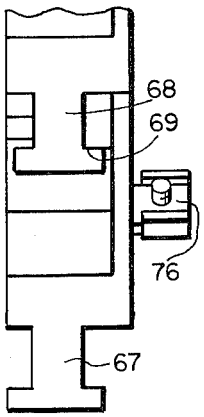
FIG. 8 is a fragmentary side view, taken on the line VIII—VIII of FIG. 5.
Figure 6:
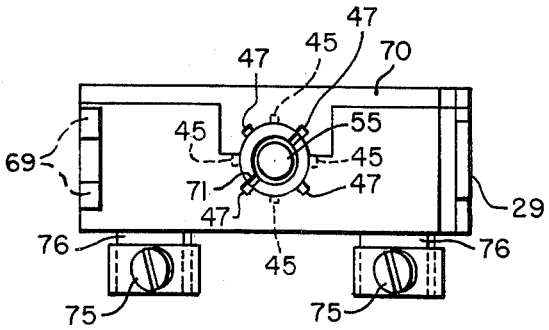
FIG. 6 is a bottom view of one of the contact blocks as shown in FIG. 5.

Another embodiment of the invention is shown in FIGS. 5, 6, and 8, in which two contact blocks or switches 28, 29 are mounted together in tandem and operatively connected to a control operator or actuator 30. The contact blocks 28, 29 are similar and comprise another embodiment of the contact block 10. Like the contact block 10, the contact block 28 comprises a housing 31 of electrically insulating material and forms a compartment 32 in which a pair of stationary contacts 33 and 34 are mounted. Corresponding movable contacts 35 and 36 are provided in a normally open position and mounted on a flexible bridging contact carrier 37. The contact carrier 37 is mounted in a contact actuator 38 having upper and lower plungers 39, 40. A coil spring 41 maintains the contacts actuator 38 in the uppermost position so that the contact block 28 is normally open. A spring retainer 42 is disposed at the lower end of the spring 41. As shown in FIG. 5, the upper plunger 39 extends through a hole 43 and a similar hole 44 is located on the opposite side of the housing and in which the spring retainer 42 is located.

Figure 7:
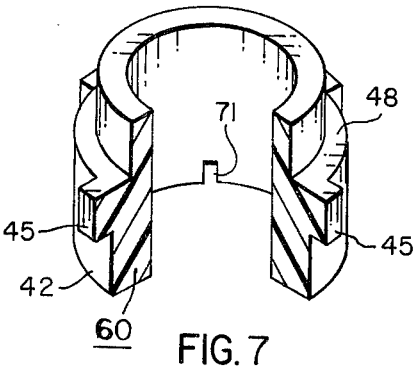
FIG. 7 is an enlarged perspective view of a spring retainer.

In FIG. 7, the spring retainer 42 is an annular member having a plurality, such as four, out-turned projections 45 which are seated against a shoulder 46 disposed within each hole 43, 44. Corresponding longitudinal slots 47 (FIG. 6) provide, in combination with the projections 45, a bayonet type connection, whereby the spring retainer may be inserted into the holes 43, 44 and twisted until the projections 45 are disposed against the shoulder 46. The spring retainer 42 also includes an annular flange 48 against which the lower end of the spring presses when the spring retainer is in place.

The contact block 29 is similar in construction to the contact block 28, and both contact blocks are shown disposed in end-to-end abutment or in tandem. The contact block 29 includes a dielectric housing 49 having a chamber 50. For purposes of illustration the contact block 29 is normally closed, that is, stationary contacts 51, 52 are disposed at the upper side of the chamber 50. A contact actuator 53, having upper and lower plungers 54, 55, is inverted with respect to the contact actuator 38 in that movable contacts 56, 57 are disposed on the upper side of a bridging contact carrier 58 and against the corresponding stationary contacts 51, 52 where they are retained in place by a spring 59, the lower end of which presses against a spring retainer 60.

Although the contact blocks 28, 29 are shown as normally open and normally closed, respectively, either contact block may be in the opposite condition, or both may be in the same condition, depending upon a particular set of requirements. The contact blocks 28, 29 being in tandem are actuated by the control operator or actuator 30 which comprises a push-button 61 extending through a hole 62 in a wall 63. Within a casing 64 a disc 65 is mounted on a rod 66 at the inner end of the push-button 61. A spring (not shown) retains the assembly of the push-button rod and disc in the position shown. When the push-button 61 is depressed, the plungers 39 and 54 are likewise depressed immediately, whereby the contacts 33, 35, 34, 36 in the block 25 are closed and the contacts 51, 56, 52, 57 in the block 29 are opened.

Each contact block 28, 29 includes similar latching hooks 67, 68 which engage cooperating in-turned latching surfaces 69 on corresponding surfaces of the adjacent control blocks. To disengage one block from another, a latching hook 67, 68 is pryed outwardly from its condition of engagement with a corresponding latching surface, and the assembly of the blocks 28, 29 separates.

Each contact block 28, 29 includes a cover, such as a cover 70 (FIG. 6) which is permanently attached to the block after the several parts are assembled therein. Thereafter, to convert either block from a normally closed to a normally open condition, or vice versa, the assembly of the spring 41 and the spring retainer 42 is removed by rotating the spring retainer, such as by the insertion of a screwdriver in rotating slots 71 until the spaced projections 45 align with corresponding slots 47 so that the assembly can be removed longitudinally from within the block. The block is then turned end for end and the assembly of the spring and spring retainer are inserted in the opposite end of the block, whereby the spring applies a reverse pressure on the contact actuator to provide either a normally open or normally closed contact block. At the same time the positions of the plungers 39, 40 or 54, 55 are reversed so that an extension adaptor 72 is attached by inserting an adaptor plug 73 into a bore 74 at the outer end of each plunger.

When a contact block 28, 29 is converted from a normally open to a normally closed position or vice versa, it is necessary to remove the clamp and screw assembly 75 on each terminal 76 so that access to the screw of the assembly is from the lower side of the terminal. The reason for the change is that when assembled with an actuator or an adjacent contact block, a screwdriver cannot be easily inserted into a screw of the assembly when it faces the wall 63.

In conclusion, the device of the present invention provides a convertible contact block which can be converted from a normally open to a normally closed condition or vice versa, by either detaching a cover from the contact block and rotating the contact actuator 180° and returning the cover, or by removing a spring and spring retainer assembly from the block and inserting it into the other end thereof. The advantage of the convertible contact block of this invention is that it is not necessary to store separate normally open and normally closed contact blocks, and a man in the field may convert a block from one position to the other in an expedient manner.

What is claimed is:

1. A convertible switch structure comprising a push button actuator, and at least two contact blocks stacked in end-to-end surface abutment; each contact block having a dielectric housing including opposite end walls and opposite side walls forming a contact compartment, each block having stationary and movable contacts; each block also having movable contact operating means including a guided reciprocable plunger, the opposite end walls of each contact block having plunger-receiving openings; the openings of each contact block being aligned, the plungers of adjacent contact blocks being in end-to-end abutment, one plunger being operatively connected to the push button actuator, each movable contact operating means also comprising a bridging contact member upon which the movable contacts are mounted, said means also comprising spring means for biasing the plunger toward the push button operator, the stationary contacts being mounted in the compartment adjacent one end wall thereof, the push button actuator comprising a casing having a bottom wall in abutment with the end wall of a contact block, the casing and housings having interlocking means for holding the actuator and switch blocks together; the interlocking means comprising similar latching hooks, one hook at one corner of the block and another hook only at a diagonally opposite corner of the block, each block also having cooperating in-turned latching surfaces only at other diagonally opposite corners, the hooks being detachably engaged with the latching surfaces, the casing also having latching hook means on one side and cooperating in-turned latching surface means on the other side which latching means engage corresponding interlocking means on the adjacent contact block, the opposite walls of each contact block being reversely mounted with respect to an adjacent block or casing to effect conversion of said block between normally open and normally closed contact modes, and the movable contact operating means being reversible within the compartment when the corresponding contact block is reversely mounted.

* * * * *